United States Patent [19]

Kamii et al.

[11] 4,023,391

[45] May 17, 1977

[54] METHOD OF AND APPARATUS FOR CONTROLLING THE SHAPE OF ROLLED OBJECTS IN THE ROLLING OF PLATE, SHEET, STRIP AND THE LIKE

[75] Inventors: Norimasa Kamii; Choshiro Yamamoto; Ryoji Terakado, all of Muroran, Japan

[73] Assignee: Nippon Steel Corporation, Tokyo, Japan

[22] Filed: Nov. 24, 1975

[21] Appl. No.: 634,738

Related U.S. Application Data

[63] Continuation of Ser. No. 453,021, March 20, 1974, abandoned.

[52] U.S. Cl. ..... 72/200

[51] Int. Cl.[2] ..... B21B 27/08

[58] Field of Search ..... 72/7, 8, 11, 13, 200, 72/201, 202, 236; 165/89, 90

[56] References Cited

UNITED STATES PATENTS

| | | | |
|---|---|---|---|
| 3,049,950 | 8/1962 | Pearson | 72/8 |
| 3,182,587 | 5/1965 | Woodhall | 72/200 X |
| 3,213,655 | 10/1965 | Reid | 72/11 |
| 3,387,470 | 6/1968 | Smith | 72/7 |
| 3,616,669 | 11/1971 | Shumaker | 72/200 |

FOREIGN PATENTS OR APPLICATIONS

| | | | |
|---|---|---|---|
| 13,611 | 12/1971 | Japan | 72/201 |
| 286,944 | 2/1971 | U.S.S.R. | 72/200 |

*Primary Examiner*—C.W. Lanham
*Assistant Examiner*—E. M. Combs
*Attorney, Agent, or Firm*—Wenderoth, Lind & Ponack

[57] ABSTRACT

A method of controlling the shape of rolled objects in the rolling of plate, sheet, strip and the like through the adjustment of the quantity of a crown made on the rolling roll by heating the inside of the center hole made along the center axis of the rolling roll.

6 Claims, 22 Drawing Figures

METHOD OF AND APPARATUS FOR CONTROLLING THE SHAPE OF ROLLED OBJECTS IN THE ROLLING OF PLATE, SHEET, STRIP AND THE LIKE

This application is a continuation of application Ser. No. 453,021, filed Mar. 20, 1974, now abandoned.

BACKGROUND OF THE INVENTION

The present invention relates to a method of controlling the shape of rolled products in the rolling of plate, sheet, strip and the like (hereinafter called plate etc.), more particularly a method of controlling the flatness and cross-sectional contour of rolled objects by controlling the thermal expansion of the rolling roll.

As a method of controlling the shape of rolled objects in the rolling of plate, etc., there is known a method according to which the shape of the gap formed between the upper and the lower working rolls, is made changeable in the direction of the axes of the working rolls by applying bending forces to the working rolls or the back-up rolls thereof by oil pressure or otherwise. Besides said method using external force mechanically applied to rolls, there are available such methods as changing the thermal expansion of the rolls in the direction of the axes of the rolls through changes of the equilibrium between the quantities of heat supplied into and escaping from the rolls either by an adjustment of the quantity of a coolant (water, an emulsion containing oils or fats or the like) sprayed on the surface of the rolls for cooling them, or by changing the distribution of flows of such coolant in the direction of the axes of the rolls.

Also, there is used for such rolling operations as skin pass rolling that use no coolant, a method of changing the shape of rolled objects by the adjustment of thermal expansion of the rolls in the direction of the axes of the rolls through the selection of the capacity of and switching on and off of a great number of gas burners along the surface of the rolls in the direction of the axes of the rolls.

Because rolls play the most important role in keeping the rolling mill rigid, and also for good accuracy of the size of the rolled products, the rolls have a large cross-sectional size. Therefore, in the method of using externally applied mechanical force on the rolls for controlling the shape of rolled objects, in order that such a force be sufficient for bending the rolls it must be very large; otherwise, no effect will be obtained; hence the apparatus for carrying out this method is large. Likewise, it is very difficult to provide an existing rolling mill with a large size apparatus for controlling the shape of rolled objects.

Also, in the methods that have been used as described above, their effect on the shape of rolled objects can be followed theoretically only with difficulty which constitutes a drawback of such methods. Specifically speaking, it is known that the greater the relative quantity of a coolant applied to the middle part of the roll, the smaller the expansion of the middle of the roll; but it is difficult to quantitatively determine the amount of reduced expansion of the middle of the roll. As for the method utilizing the change of rolling load, it may be effective for controlling the shape of rolled objects in only one rolling mill, but it also affects the operation of other rolling mills, requiring special care in using such a method. Besides, by the use of such a method the cross-sectional contour of rolled objects can be controlled only with great difficulty. As for the roll bending apparatus, it is difficult to properly adjust it only by using theoretical considerations, because of the influence of the interlocked factors such as the variance in shape controlling effect according to the change of rolling load, the changing distribution of the rolling load in the direction of the axes of the rolls and also the changing distribution of the rolling force between the working rolls and the back-up rolls in the direction of the axes of the rolls.

Because of the difficulty in applying theoretical considerations for controlling the shape of rolled objects in the rolling of plate, etc. by the conventional methods, actual control has not been carried out theoretically but by using the sight of operators or an output signal from a detector of the outside appearance or the like. For the control of the cross-sectional contour of plate, etc. (the distribution of thickness in the width direction of plate, etc.), a roll bending apparatus having a small controlling effect is not used, but the means for adjusting the supply of roll coolant is used in most cases, which makes it still more difficult to apply theoretical considerations for the determination of the effect of the control. Recently, strips produced in a hot strip mill having a high efficiency have sometimes had concave middle parts as a result of insufficient cooling of the rolls due to unbalance between the cooling of the rolls and production efficiency (Ton/Hr). As the result, it is very difficult to obtain desired shapes of the products made from a coil for cold rolling which coil is formed by rerolling such strip, so that it has become necessary to lower the production rate for compensating for the insufficient cooling. This is a difficulty which occurs in the case where the quantity of heat supplied to the rolls is too great to be offset by heat removal by a roll coolant. How to overcome formation of a thermal crown on the rolls, which causes the production of a middle concave part of the strip, is a difficult problem to solve.

In the case of applying an initial crown to the rolls prior to the operation for solving the above problem, there is used a method of providing an initial crown according to the purpose for which the hot coils are to be used. However, it is easily understood that the initial crown cannot be controlled while the rolls are in operation.

SUMMARY OF THE INVENTION

An object of the present invention is to provide a method of accurately controlling the shape of rolled objects in the rolling of plate, sheet, strip and the like through the adjustment of the thermal crown of the rolls.

Another object of the present invention is to provide a method of controlling the shape of rolled objects in the rolling of plate, etc. with the thermal crown of the rolls being adjusted while the rolls are in operation.

A further object of the present invention is to provide a method of controlling the shape of rolled objects in the rolling of plate, etc. with the thermal crown of the rolls being adjusted by supplying a small quantity of heat to the rolls.

These and other objects of the present invention will become clearer when reference is made to the detailed description and embodiments of the same given below.

In order to attain the abovementioned objects, the method of the present invention for controlling the shape of rolled objects in the rolling of plate, etc. comprises heating the inside of the center holes made along the respective center axes of the rolls for the adjustment of the quantity of crown on the rolls, whereby control of the shape of plate, etc. is possible.

The apparatus for carrying out the method of the present invention for controlling the shape of rolled objects in the rolling of plate, etc. comprises a center hole made along the center axis of each of the rolling rolls, and a heat-generating body provided in each of the center holes, such bodies having respectively different heat patterns.

BRIEF DESCRIPTION OF THE DRAWINGS

FIG. 12 is an explanatory view of one example of the progression schedule for the rolling of plate, sheet, strip and the like.

FIG. 15 is an explanatory view for the definition of the quantity of crown formed on rolled plate, sheet, strip and the like.

FIG. 16 is a graph of one example of the change of the quantity of crown formed on rolled plate, sheet, strip and the like.

DESCRIPTION OF THE PREFERRED EMBODIMENT

In order to have the rolls expanded as effectively as possible per a fixed quantity of thermal energy, it is recommended that heat be supplied outwardly from the central part of the roll. This recommendation is derived from the following consideration: when comparing the application of pressure to a thick-walled cylinder from within a center hole to the application of pressure to the outer surface, the same quantity of pressure (absolute pressure) produces greater deformation at the outer surface when it is applied in the former manner than in the latter manner.

According to this theory of thick-walled cylinder deformation the ratio between the two manners of application of pressure in effect is:

$$\{(1-\mu)\,n^2+(1+\mu)\}/2:1$$

where $\mu$, Poisson ratio = 0.3

$n$ is the ratio between the outer diameter, $\gamma_0$ and the inner diameter, $\gamma_i$, $\gamma_0/\gamma_i$, assuming that; $\gamma_0 = 325$ mm and $\gamma_i = 25$ mm, the ratio equals 85.

In the present invention, the above theory is applied to the control of the shape of rolled product in the rolling of plate, etc., in such manner that stress corresponding to the above described inside pressure, is added into the center hole provided along the center axis of the roll, that is, thermal stress due to temperature rise in the vicinity of the center hole is changed along the direction of the axis of the roll, so as to change the quantity of crown.

Another advantage of heating the cylinder from the inside is that a smaller quantity of the thermal energy is transmitted from the central part in the axial direction than in the radial direction; the greater part thereof flowing in the latter direction. A further advantage is that a local rise of temperature can be produced easily.

On the contrary, the supplying of heat from the outer surface causes the thermal energy to run in the axial direction as well as in the radial direction, which causes heating of the portion which is not required to be heated. Besides, the volume required to be heated is so great as to make it difficult to raise the temperature locally; in other words, in order to get a great difference in thermal expansion locally in the axial direction, a great quantity of heat is required, offsetting the effect of roll cooling.

Figure 1:
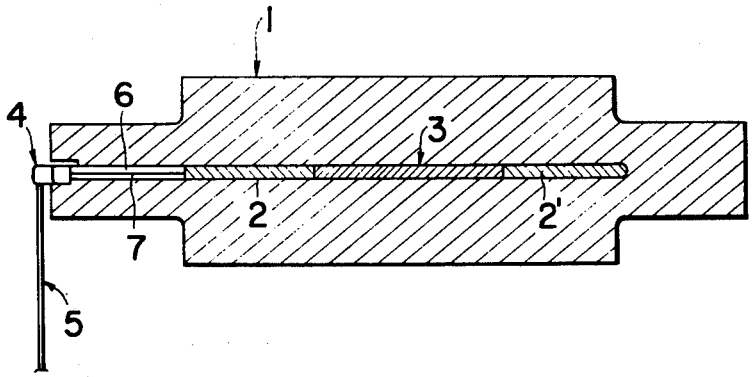
FIG. 1 is an explanatory view of the cross-section of the roll for a rolling roll equipped with a crown adjusting device, to illustrate an embodiment of the present invention.

FIG. 1 shows the construction of the apparatus of the present invention. Numeral 1 designates a working roll; numeral 6 designates a hole made along the center axis of the roll, in which are contained heat generating bodies 2, 2' and 3 (electric bar-heaters in this case); numeral 7 designates a lead; numeral 4 designates a rotating coupling to supply power from outside to the heat generating bodies set in the roll during operation; numeral 5 designates a flexible link supporting the lead and the rotating coupling to connect them with an electric power source. The heat generating bodies 2 and 2' are connected in series, so that current is supplied to both sides of the roll in the axial direction simultaneously. In this case, the heat generating body 3 should be wired in a different circuit from that for the heat generating bodies 2 and 2' for better controlling effect.

An embodiment of the above-mentioned heat generating body will now be described.

Figure 2:
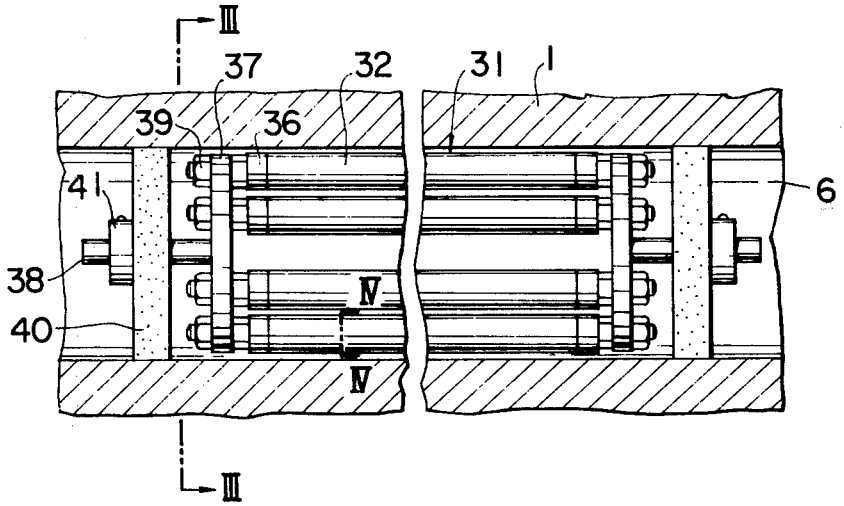
FIG. 2 is an elevation of a heat-generating body according to the present invention in an enlarged partial section of a working roll.
Figure 3:
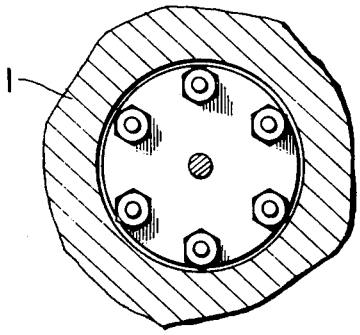
FIG. 3 is a sectional view taken along the line III—III of FIG. 2.
Figure 4:
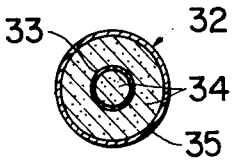
FIG. 4 is an enlarged sectional view taken along the line IV—IV of FIG. 2.
Figure 5:
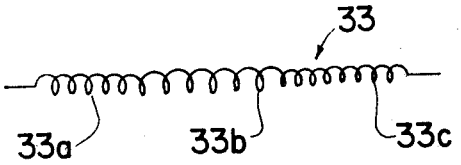
FIG. 5 is a schematic illustration of a winding of the nichrome wire shown in FIG. 4.

A heat-generating body illustrated in FIG. 2 and FIG. 3 is an electric heater; six bar-shaped heat-generating elements 31 are inserted into the center hole 6 of the working roll 1 in parallel with the axis of the working roll 1.

Each of the heat-generating elements 31 comprises a coiled nichrome wire 33 and a stainless steel tube 35 with which the nichrome wire 33 is sheathed, and which is filled with magnesium oxide 34 for electric insulation. The coil pitch of the nichrome wire 33 at the end portions 33*a* and 33*b* is smaller than that at the middle portion 33*b*, instead of being an equal pitch, in order to obtain the heat distribution in the working roll 1 which develops the desired thermal crown.

Laminated mica rings 36 are secured at the opposite ends of the heat-generating element 32 for preventing contact between the working roll 1 and the heat-generating elements 32.

Furthermore, each heat-generating element 32 is bolted to a connecting disc 37 of metal by nuts 39 on threaded studs attached to elements 32 at electrode 38 extending outwardly. The electrode 38 is fastened to a disc insulator 40, which is secured to the working roll 1, with a clamp 41. Therefore, the six heat-generating elements are fixed in the center hole 6 of working roll 1 and are electrically insulated therefrom.

Besides the above-mentioned construction, the apparatus has an electric power source equipped, as a matter of course, with a voltage regulator. The heat-generating bodies may be provided in a greater number than described above for better results in the practice of the present invention.

Figure 6:
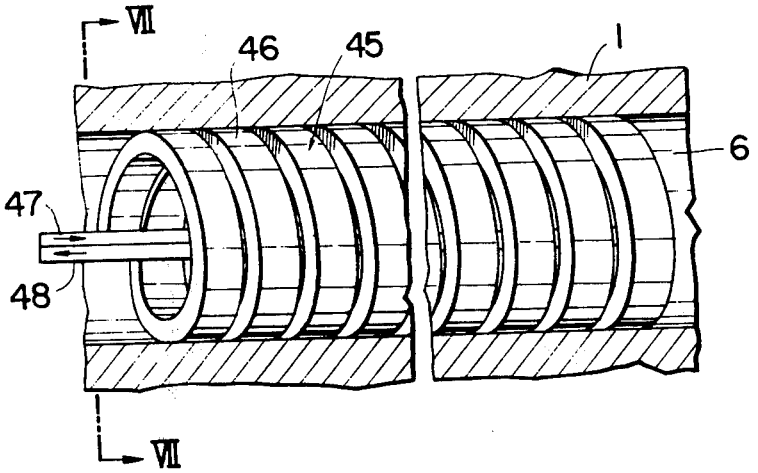
FIG. 6 is an elevation of another embodiment of a heat-generating body in an enlarged partial section of a working roll.
Figure 7:
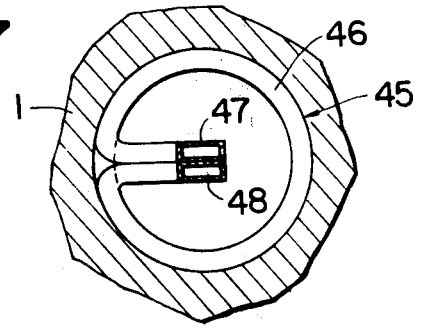
FIG. 7 is a sectional view taken along the line VII—VII of FIG. 6.
Figure 8:
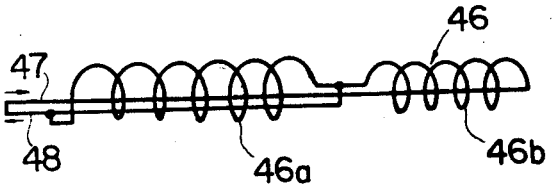
FIG. 8 is a schematic illustration of a winding of the oil tube shown in FIG. 6.

A heat-generating body shown in FIG. 6 and FIG. 7 is another embodiment of heat-generating means which can be used in the method of the present invention. The heat-generating body 45 comprises a coiled heating tube 46. High temperature oil flows through the heating tube 46 from an inlet 47 to an outlet 48. FIG. 8 illustrates coiled tube 46*a* and 46*b* arranged symmetrically. The coil pitch of the heating tube 46 may be varied along the axis of the working roll 1 as is the above-mentioned electric heater.

The center hole 6 of the working roll 1 may be filled with heat resisting resin after inserting the heating tube 46, or a clamp may be used in order to fix the heating tube 46 in the center hole 6 of the working roll 1.

Steam is available for use as a medium in place of oil.

Figure 9:
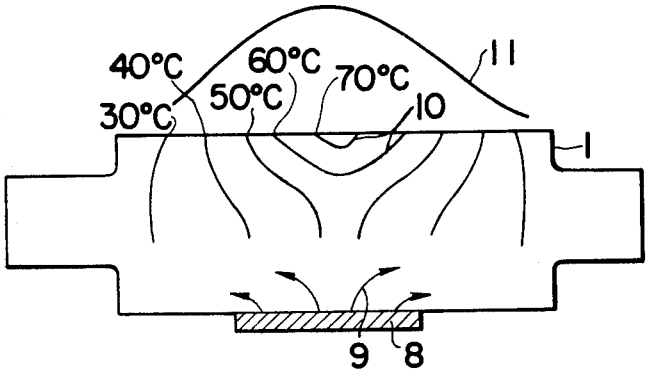
FIG. 9 PRIOR ART
FIG. 9 is a schematic illustration of the temperature distribution during rolling by the conventional method.

FIG. 9 is a diagram showing the temperature distribution inside the working rolls during an operation for the hot rolling of plate, etc. according to the conventional rolling method. At the central part of the roll body, the heat 9 transmitted from the surface of the to-be-rolled material 8 and generated by the friction of the rolling operation, causes the temperature at said part to rise.

On the other hand, the temperature at the ends of the roll body, rises due to thermal current transmitted from the central part, but, at the same time, it is reduced at the surface part by cooling with coolant. Generally speaking, the distribution 11 in the axial direction of the roll, of the roll surface temperature 10, takes a form similar to a parabola. As a result of the thus produced difference in temperature between the central part and the end parts of the roll, the central part expands to form the so-called thermal crown. This is the greatest trouble which occurs in rolling operations, in terms of difficulty of control. The thermal crown grows according to the quantity of rolled product, until an equilibrium of heat transfer is reached during continuous operation at the same conditions. Besides, the amount of thermal crown varies according to the operation efficiency, the width of the rolled material, etc.

Figure 10:
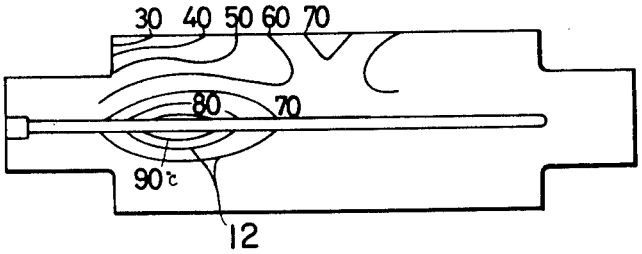
FIG. 10 is a schematic illustration of the temperature distribution during rolling according to the present invention.

FIG. 10 shows the roll temperature distribution 12 appearing in the operation according to the present invention, which operation is carried out with heat supplied from the center hole of the roll, particularly from both ends of the hole, such heat having been generated from electric power by electric heaters constituting the heat-generating bodies 2 and 2' at the end parts of the roll. As is clear from the drawing, a great change occurs in the temperature distribution 12 at the end parts of the roll, so that a great thermal expansion takes place at the vicinity of the center hole, resulting in the enlargement of the roll outward, that is, in the radial direction.

The following is a description of an embodiment of the present invention.

Rolling mill:
- Diameter of working roll: 640 mm
- Length of working roll: 1422 mm
- Diameter of back-up roll: 1245 mm
- Length of back-up roll: 1372 mm Rolled object: Low-carbon-content steel
- Width: 735 mm
- Thickness at inlet: 2.9 mm
- Thickness at outlet: 2.3 mm Rolling rate: 500–590 m/min.
Rolling efficiency: 330 tons/hr.
Rolling temperature: 900° – 880° C.
Rolling cooling water temperature: 27° C
Rolling cooling water quantity: 350 $m^3$/hr. (uniformly spraying)
Heat-generating body: Electric heater, 30 mm dia. × 400 mm long (two bodies, each between respective end of the roll body and 400 mm therefrom)
Power of heat-generating body: 3.0 kw × 2 (two bodies)
Diameter of the hole in the roll: 50 mm
Surface temperature of the hole: 93.5° C (at 200 mm from the end of the roll body)
Surface temperature of the roll: 65° C at the center, 37° C at 20 mm from the end
Result of the above rolling operation:
Roll surface temperature: No difference right after rolling according to whether or not power was supplied
Shape of the rolled object after rolling No. 5 pass: Edge wave (slackening on both ends) observed on the object rolled by the rolls having the same initial crown as according to the conventional method when no power was supplied; flat when power was supplied.
Relation between power supply and initial crown: When no power was supplied, the rolled object was flat when the initial crown was 0.10 mm (reduced diameter respectively of the upper and the lower rolls). When power was supplied, the object was flat with an initial crown of + 0.02 mm.

The above described embodiment shows that, with such a simple device as two electric heaters each having a capacity of 3 kw inserted in the center hole made along the axis of the roll, it is possible to control the shape of the roll as effectively as when using an initial crown of 0.12 mm. In other words, the present invention makes it possible to control the shape of rolled plate, etc. over a very wide range by using an initial roll crown set at an intermediate value as the above-mentioned embodiment and by supplying power to the central electric heater.

In the above-described embodiment, more than two heat-generating bodies having respectively different quantities of generated heat, were provided in each of the working rolls, thereby making it possible to control the temperature distribution of the rolls for the control of the thermal crown.

On the other hand, the following is a description of another embodiment of the present invention, in which a simplification of the heat supply to respective rolls and a rise of rolling efficiency were obtained by using different heat patterns in the upper and the lower rolls facing the to-be-rolled material produced by the energy supplied to the center hole of the respective rolls, in the light of the particular rolling operation to be carried out with the pair of rolls.

Figure 11:
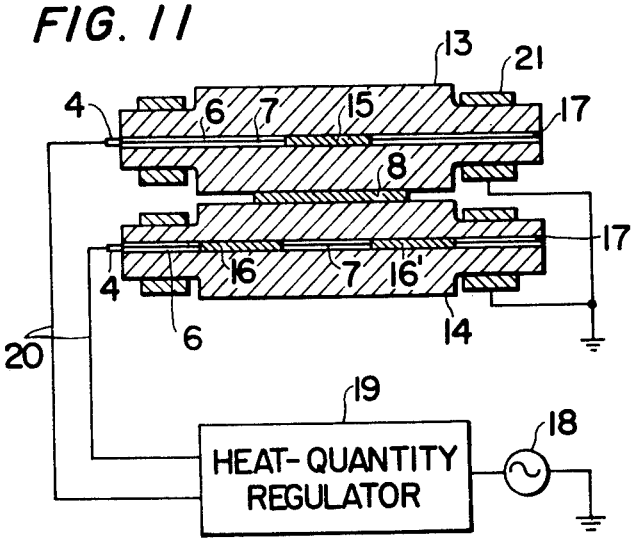
FIG. 11 is a cross-sectional view of rolling rolls equipped with a crown adjusting device, to illustrate another embodiment of the present invention.

In FIG. 11, an upper working roll 13 has a heat-generating body 15 inserted in the hole 6, nearly at the center of the working surface of the roll, relative to the width direction; and a lower working roll 14 has heat-generating bodies 16 and 16', therein having a heat pattern different from that of the heat-generating body of the working roll 13.

The use of heat-generating bodies having different heat patterns in the upper and the lower working rolls, as mentioned above, makes it possible to obtain the same effect as is obtainable by using heat-generating bodies having different heat patterns in one and the same roll.

According to the present embodiment, each roll has a single heat-generating body, as mentioned above, so that the rotating coupling 4 may be the one for a single circuit. That is to say, in the case where electric power is used as a heat source, as shown in the drawing, electric power supplied from the electric power source 18 is branched by a heat quantity regulator 19 and supplied separately through leads 20 to the upper and the lower working rolls. The thus supplied electric current runs through a coupling 4, lead 7, the heat-generating body 15 or the bodies 16 and 16', points 17, bearings 21 and the roll housing to ground thus completing a closed circuit. When using electric power as a heat source, any kind of electric power source may be used, so long as it can regulate voltage and amperage separately. When using another heat source in the form of a fluid, whatever can be regulated separately according to supply volume and temperature, may be used.

In the case of using a fluid as a heat source, the ground point 17 is open for one-way flow of the fluid, making the arrangement of the lead and of the piping simple.

As mentioned above, the use of rolls having different heat patterns generated by the heat-generating body according to the present invention, is as effective as the use of rolls, each having a varied heat pattern generated by the heat-generating body. However, the former case is simpler in terms of construction than the latter case, where a plurality of controlling systems are required for one roll. This makes the present invention very valuable on a commercial line. The following describes more in detail the present invention with an explanation of how to control thermal crown, as the rolling operation proceeds.

Whichever is being carried out, hot rolling or cold rolling, the rolling of plate, etc. results in a rise of temperature in the central part of the body of the roll due to the transmission of heat from the rolled plate, etc., greater then the rise of temperature at the ends of the rolls which are not so much influenced by the rolling operation. How high they rise, depends on the width of the rolled plate, etc., rolling efficiency, etc., and can be estimated from the construction of the rolling mill and of the rolled object and rolling efficiency. That is to say, the change of formation of thermal crown taking place during actual rolling operations, can be estimated from the above-mentioned rolling conditions, so that the thermal crown required for the rolling roll at a certain moment can be controlled, that is increased or reduced by observing the cross-sectional contour of the rolled object while taking the other operational data such as the rolling progression schedule, into consideration.

Figure 12:
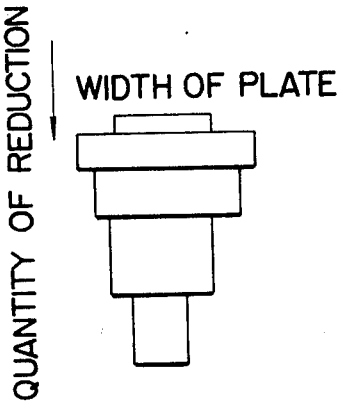
Figure 13:
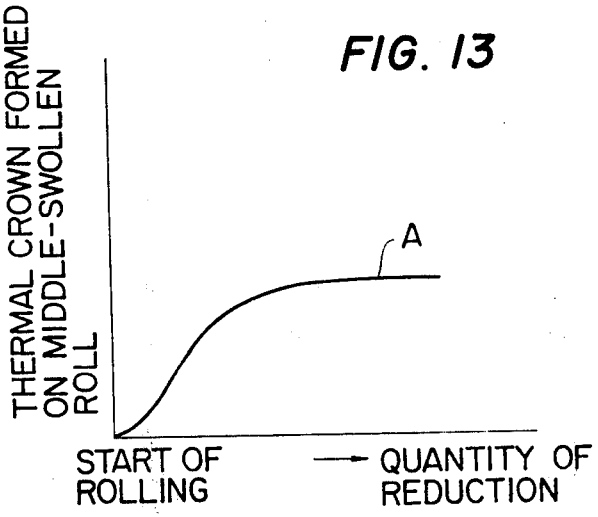
FIG. 13 is a graph of the change of thermal crown formed on the working rolls while these are operating.
Figure 14:
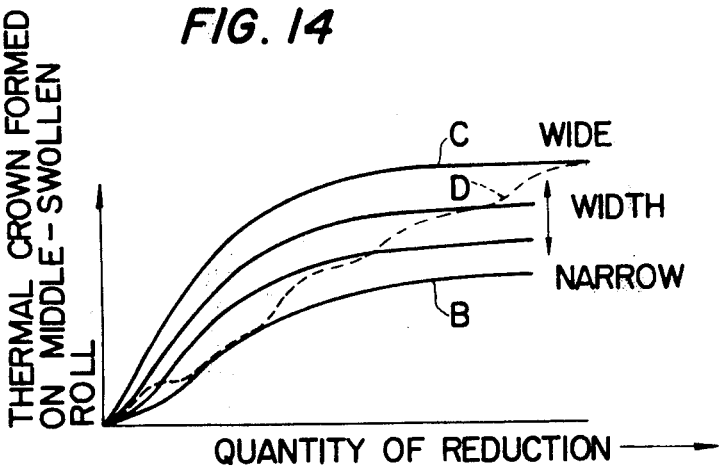
FIG. 14 is a graph of the change of thermal crown formed on the working rolls according to the progression schedule.

FIG. 12 shows a schedule of rolling operations usually carried out in a strip mill. At first, a small quantity of a material of rather small width is rolled; then, a material of great width and then a material of small width, are rolled; thus, the size of the to-be-rolled material is changed according to the rolling lot. Such a sequence of the rolling operations makes the supply of heat into the rolls enough to form a thermal crown, and hence the expansion of the middle of the roll. The extent of such middle expansion depends on the size, particularly the width of the to-be-rolled material and rolling efficiency (ton/hr). One example of the determination of such extent is: if a to-be-rolled material of a certain width continues to be rolled at a certain rolling efficiency, thermal crown forms on the roll as traced by the curve A shown in FIG. 13. However, in actual operation, materials of various widths are rolled one after another, and formation of thermal crown is according to no single curve, but follows an irregular trend shown with a dotted line in FIG. 14, such line being within the range between the curve B for a to-be-rolled material of great width and the curve C for such material of small width. That is to say, in the rolling done according to the schedule shown in FIG. 12, thermal crown forms in such an irregular trend (dotted line D) as shown in FIG. 14. As a result, at the initial stage of the rolling operation, the rolled plate, etc., due to the provision of initial crown to compensate for later-formed thermal crown, tends to have its middle part thicker than the edges, and eventually the thickness becomes uniform and the plate, etc. becomes flat.

Figure 15:
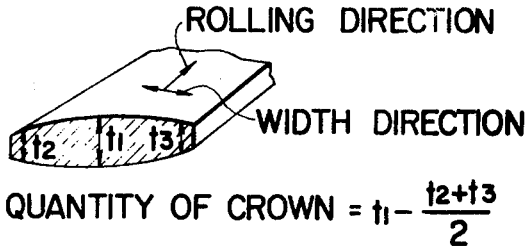

The amount of crown forming on the rolled plate, etc. is defined referring to FIG. 15, as follows:

$$T = t_1 \frac{t_2 + t_3}{2}$$

where $T$ is the amount of crown forming on the rolled plate, etc.; $t_1$ is the size of the central part of the rolled plate, etc. in the width direction; and $t_2$ and $t_3$ are respectively the sizes of both ends.

Figure 16:
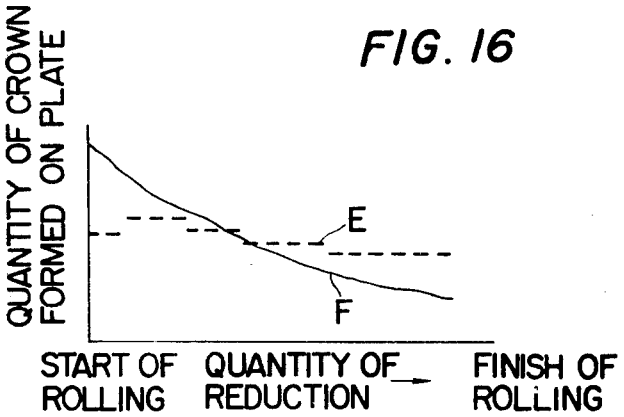

When a hot coil for cold rolling is used as an example of a to-be-rolled material, the desired amount of crown for the schedule of FIG. 12 should be as shown with the dotted line E in FIG. 16. In actual practice, however, the crown forms on the rolled object as shown with the curve F, which means that there is so great a difference in the amount between the initial stage and the final stage of the rolling operation that the amount of crown is too great for the rolled plate, etc. of small width rolled at the initial stage, but is too small for the rolled plate, etc. of great width rolled at the final stage. This phenomenon takes place due to thermal crown forming on the roll, which cannot be compensated for even by a change of the amount of initial crown.

In order to control such thermal crown, a heater is provided in the roll at the central part thereof in the axial direction, so as to adjust the quantity of to-be-supplied heat for this purpose. It is one of the special characteristics of the present invention to predict and adjust the quantity of heat to be supplied from a heater provided in the center hole of the roll.

The heater inserted in the center hole of the roll should be divided into an appropriate number of portions, so that the heating can be controlled so as to be most effective at the central part and also at the ends of the roll. By controlling the distribution of generated heat, that is, the heat pattern in the long direction of the roll, it is possible to control the thermal crown forming on the roll.

Figure 17:
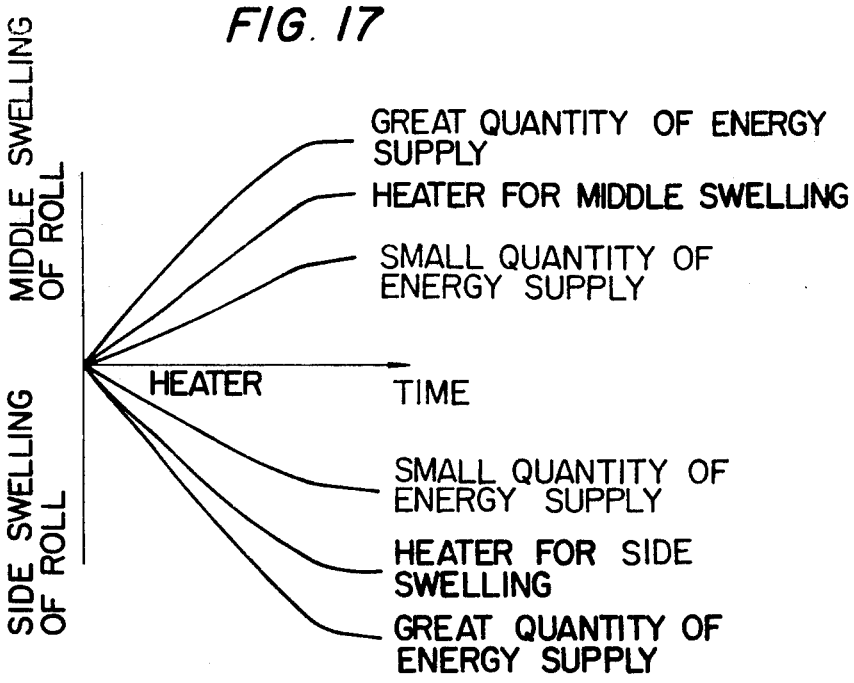
FIG. 17 is a graph of the change of the quantity of roll crown formed by the operation of the crown adjusting device provided in the roll.

FIG. 17 shows the relation between the supply of energy into the heater parts in the central part and the ends of the roll and the formation of roll crown. If the energy supply is increased to the part of the heater for controlling the enlargement of the middle of the roll the enlargement of the middle of the roll increases; if the energy supply to said heater is controlled so as to increase the quantity of heat supplied into the parts of the heater for heating the ends of the roll the size of the ends of the roll increases, making up for the reduction of the size of the middle. The control of the distribution of heat generated by the heater can be for one roll or can be divided over two rolls, that is, the upper and the lower working rolls.

According to the present invention, the control of roll crown is carried out depending on the value of roll crown it is predicted will be attained from the initial crown prescribed at least for the above-mentioned rolls and also progression schedule, and the change of thermal crown to be formed on the roll as the rolling progresses is so controlled by means of the control of the energy supply into the heater and the distribution of heat generated by the heater, that the rolls at the start of a rolling operation will always have the desired amount of crown. If necessary in this case, the amount of crown of the rolled plate is measured, so that said control may be corrected.

Figure 18:
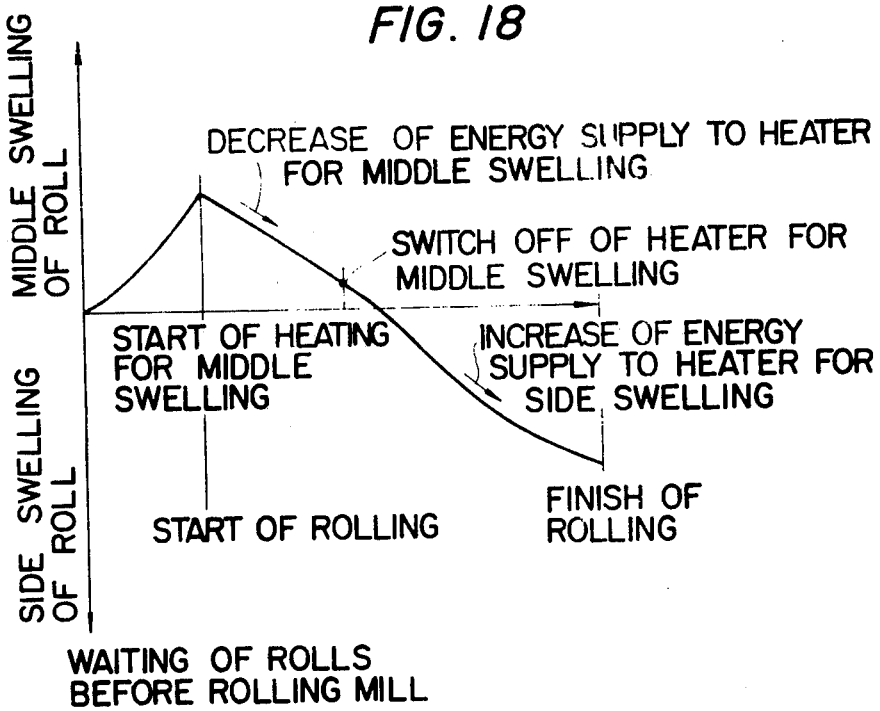
FIG. 18 is a graph illustrating an embodiment of the method of the present invention.

FIG. 18 shows the quantity of heat supplied into the roll and the distribution of heat generated by the heater, for a typical case, in which the characteristics of the change in the crown brought about by heating as shown in FIG. 17 were utilized to control heaters in the roll. According to the present invention, therefore, the roll can be given a crown from the start of operation of the same size as the thermal crown which will form during operation, thereby making it possible to roll plate, etc. with a roll having the desired and properly arranged amount of crown.

At the same time as the start of the rolling operation, the roll receives heat from the rolled plate, etc., replacing heat from the heater for enlargement of the middle of the roll until the operation of the heater is stopped some time after the start of rolling operation. As the supply of heat from the rolled plate, etc. continues increasing, the heat from the heater is reduced and the amount of enlargement at the middle of the roll is kept constant. However, if the width of the rolled plate, etc. is getting smaller in the successive operations as in the processing schedule shown in FIG. 12, the above-mentioned condition of the roll is further changed; in order to prevent a change of condition, therefore, it is necessary to put the heater parts for enlarging the ends of the roll into operation, before the start of the rolling operation. Thus, the change of crown being formed on the roll is predicted from the heat transmitted from the rolled object, that is the rolling progression schedule, including rolling efficiency, so that heat to be supplied from the heater can be adjusted, making it possible to obtain the desired quantity of crown as represented by the dotted line E shown in FIG. 16.

Thus, according to the present invention, it is possible to control the amount of crown forming on the roll throughout the rolling operation from the start to the finish or up to the working limit of the rolls prescribed according to the rolling progression schedule.

Figure 19:
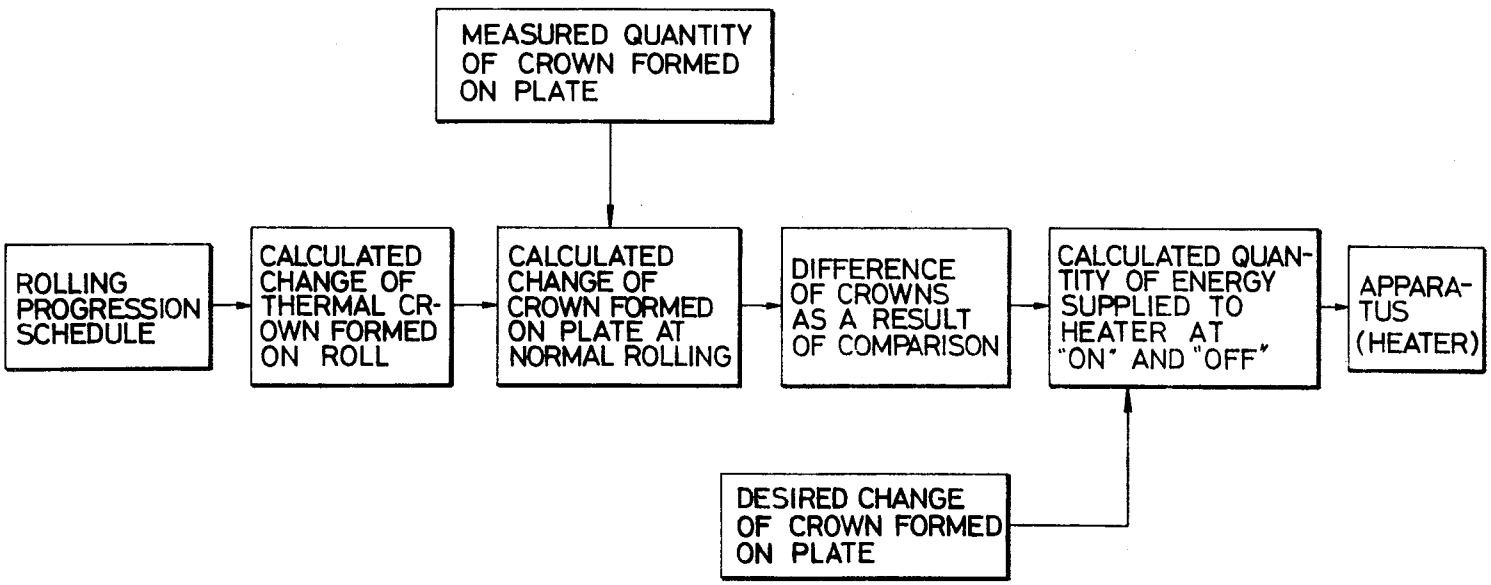
FIG. 19 is a block diagram illustrating the controlling method of the present invention.

FIG. 19 shows the procedure for rolling operations according to the present invention. At a rolling plant, amounts of products to be rolled are determined by taking the demand and supply situation and the production plan, into consideration, and also the rolling efficiency, these being made up into a progression schedule, from which is derived thermodynamically the change of thermal crown formed on the roll. Then, the change of crown forming on the plate, etc. during rolling, is determined, by taking into consideration the influence of a roll coolant and other means for the control of crown, if any. Then, the desired change of crown for the rolled plate, etc. (which takes place on the change of the size of the rolled plate, etc.) and the crown formed on the rolled plate, etc., derived as described above, are compared to determine a difference value which is turned into an output signal for the control of the supply of energy to the heater provided in the roll and control of the distribution of the thus supplied heat.

If necessary, the thus derived value of crown to form on the rolled plate, etc., is corrected in the light of the actual value of crown as measured during rolling operations.

Embodiment

Rolling operations were carried out by using a finishing rolling mill (a six-stand tandem mill) of a hot strip mill for rolling a strip of 1,422 mm (56 inches) in width, as follows.

Specifications of the rolling mill

Working roll:
Diameter: 655–596 mm
Body length of: 1,422 mm
Back-up roll:
Diameter: 1,245–1,150 mm
Length of the body: 1,372 mm In FIG. 11 there is shown an upper working roll 13 which has a hole of 40 mm in diameter running through the center along the axial direction. In the hole of the upper working roll there is inserted at the central part an electric heater 15 of 200 V, 5 KW having a heat-generating part 600 mm long. Also there is shown a lower working roll 14, which has a hole of 40 mm in diameter, containing electric heaters 16 and 16′ each of 100 V, 2.5 KW and having a heat-generating part 300 mm long. These heaters are arranged in series in the hole toward respective ends, the total capacity being 200 V, 5 KW. The above-mentioned heaters are connected with respective electric sources 18 and 19 by appropriate means for the supply of electric power.

In the meantime, initial crown measured for respective rolls of each stand is shown in the following table:

Table 1.

Initial crown for respective rolls of each stand of the finishing rolling mill.

| Stand No. | F1 | F2 | F3 | F4 | F5 | F6 |
|---|---|---|---|---|---|---|
| Upper, lower working rolls mm | $\frac{-30}{100}$ | $\frac{-30}{100}$ | $\frac{-20}{100}$ | $\frac{-15}{100}$ | $\frac{-10}{100}$ | $\frac{-5}{100}$ |
| Upper, lower back-up rolls mm | 0 | 0 | 0 | 0 | 0 | 0 |

The rolling progression schedule used in this case, is as shown in Table 2.

According to past experience, rolling efficiency was assumed to be 357 tons/hr. on an average.

Under the above-mentioned conditions, the supply of heat, respectively into the electric heater 15 of the upper working roll and the electric heaters 16 and 16' of the lower working roll, and the distribution of the so supplied heat, that is, the patterns of heat supply were subjected to control, as shown in Table 3.

Table 2

Rolling progression schedule.

| Rolling order | Size of product | Average weight of the coil | Number of rolled objects |
|---|---|---|---|
| 1 | 2.0 × 935 mm | 12.5 | 5 |
| 2 | 3.2 × 1245 mm | 13.5 | 10 |
| 3 | 2.5 × 1235 mm | 13.5 | 7 |
| 4 | 2.0 × 1025 mm | 12.5 | 12 |
| 5 | 2.0 × 935 mm | 12.5 | 30 |
| 6 | 2.0 × 860 mm | 11.5 | 15 |
| 7 | 2.0 × 785 mm | 9.8 | 25 |
| 8 | 2.0 × 735 | 9.8 | 22 |

Table 3

Patterns of heat supply to the upper and the lower working rolls.

| Stand No. Progress schedule | | F1 | F2 | F3 | F4 | F5 | F6 |
|---|---|---|---|---|---|---|---|
| 30 min. before roll mounting | UR | 200 | 200 | 200 | 150 | 150 | 100 |
| | LR | 0 | 0 | 0 | 0 | 0 | 0 |
| 10 min. before roll mounting | UR | 0 | 0 | 0 | 0 | 0 | 0 |
| | LR | 0 | 0 | 0 | 0 | 0 | 0 |
| After completion of roll mounting (for start of rolling) | UR | 200 | 200 | 200 | 150 | 150 | 150 |
| | LR | 0 | 0 | 0 | 0 | 0 | 0 |
| 30 min. after roll mounting | UR | 100 | 100 | 100 | 100 | 100 | 100 |
| | LR | 0 | 0 | 0 | 0 | 0 | 0 |
| 60 min. after roll mounting | UR | 50 | 50 | 50 | 50 | 50 | 50 |
| | LR | 0 | 0 | 0 | 0 | 0 | 0 |
| 90 min. after roll mounting | UR | 0 | 0 | 0 | 50 | 50 | 0 |
| | LR | 0 | 0 | 0 | 0 | 0 | 0 |
| 120 min. after roll mounting | UR | 0 | 0 | 0 | 50 | 50 | 0 |
| | LR | 0 | 0 | 0 | 0 | 0 | 0 |
| 150 min. after roll mounting | UR | 0 | 0 | 0 | 0 | 0 | 0 |
| | LR | 50 | 50 | 0 | 0 | 0 | 0 |
| 180 min. after roll mounting | UR | 0 | 0 | 0 | 0 | 0 | 0 |
| | LR | 150 | 150 | 50 | 0 | 0 | 0 |
| 210 min. after roll mounting | UR | 0 | 0 | 0 | 0 | 0 | 0 |
| | LR | 150 | 150 | 100 | 50 | 0 | 50 |

Remarks:
UR means the upper working roll.
LR means the lower working roll.

Figure 20:
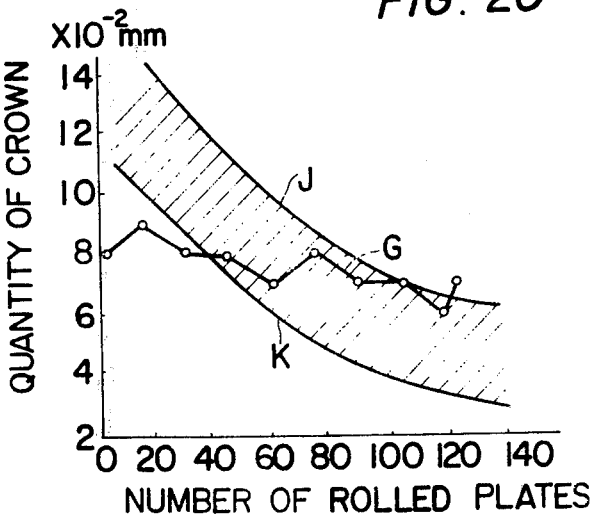
FIG. 20 is a graph of the effect of an embodiment of the present invention.

FIG. 20 shows the crown being formed on the rolled plate, etc. at a point 5 m away from the tail of the strip of the above-mentioned case, and is plotted against the number of the rolled objects. The curve G represents the crown forming according to the present invention; and the change of crown during ordinary rolling operation is sure to be within the range of the shaded area between the curves J and K, so that it can be confirmed that the rolled plate, etc. having a crown with a shape very close to the ideal one can be obtained according to the present invention.

The following is an explanation of the connection between the electric circuit, such as a heat-generating body, provided inside the rolling roll, and the electric circuit, such as an electric source, provided outside the rolling roll.

Figure 21:
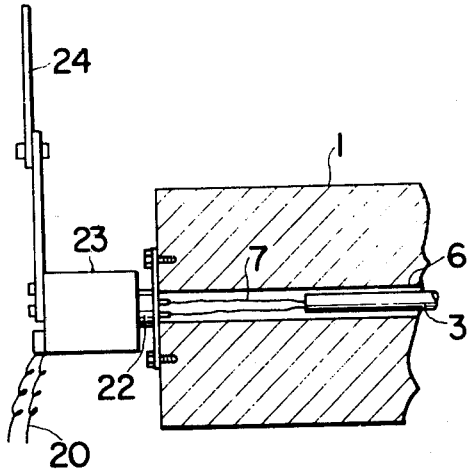
FIG. 21 is a sketch of a conventional device for connecting an electric circuit to the heater of the rolling roll, with part of the roll broken away.

An arrangement in which a conventional means for electrical connection between a rotating body and a fixed apparatus outside the body, is used for the rolling roll which is used in the method of the present invention, is shown in FIG. 21.

As shown in the drawings, the rolling roll 1 is equipped with rotating contact means 22 and 23 each having a slip ring and other members. However, it cannot be said that the rolling roll 1 containing the electric circuit inside operates all the time under good operation conditions.

Where the rolling roll is that for a hot strip mill or a cold strip mill according to the present invention, there must be used a great quantity of coolant, causing the atmosphere around the rolls to contain a great quantity of water in drops and moisture; and the rolls receive a strong impact from the rolled strip; these severe rolling conditions make it difficult to completely protect the rotating contactor.

In FIG. 21, the lead 7 reaching the end of the rolling roll 1 through the center hole 6, is connected with the rotor 22 of the rotating contactor. This rotor 22 is fixed on the rolling roll 1, so as to rotate together with the rolling roll 1. In addition to this rotor 22, there is the stator 23 having carbon brushes, which electrically connects the lead 7 inside the rolling roll 1 with the lead 20 of the electric circuit outside the rolling roll 1 while it contacts the rotor 22. Numeral 24 designates a stop arm connected with the stationary member for the prevention of swinging of the stator 23 by the rotor 22. The above-mentioned is a widely used, conventional means for connecting an electric circuit inside a rotating body with that outside it, as is used with the rolling rolls of the present invention. As mentioned above, there may be cases where due to the operating conditions of the rotating body, the rotating contactor is placed under bad conditions.

Figure 22:
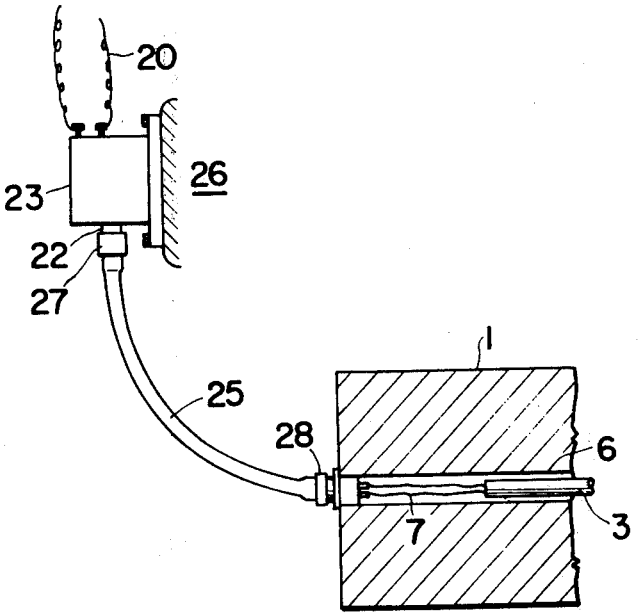
FIG. 22 is a sketch of an embodiment of the device of the present invention for connecting the electric circuit to the heater of the rolling roll, with part of the roll broken away.

According to the present invention, the rotating contactor itself is fixed on a stationary member 26 separate from the rolling roll 1 as shown in FIG. 22, and the rolling roll 1 and the rotor 22 of the rotating contactor are electrically and mechanically connected with each other by means of a flexible shaft 25 so as to transmit rotation. The sheath of the flexible shaft 25 is made of an electrically insulating material.

The conductor for transmitting rotation and electricity is made of wire of a material of high conductivity and flexibility such as phosphor bronze. The flexible shaft 25 is multilayered according to the number of poles of the electric circuit; these layers being electrically separated from each other by an electrically insulating film or the like, so as to have the same number of circuits as poles. Also, both ends of the flexible shaft 25 have bayonet sockets 27 and 28 in a number corresponding to that of the poles, each to connect with its counterpart for free removal.

According to the present invention, one pole of the electric circuit is led directly to the roll, and grounded to the rolling mill, so that the number of the poles taken out of the end of the roll through the rotating contactor is one, making it possible to use a single circuit for the flexible shaft 25, thereby making the arrangement very simple.

In the case of the conventional arrangement, the rotating conductor must be taken off and then put back on every time replacement of rolls is carried out, or each roll has to be equipped with its own contactor; such inconvenience is obviated in the present invention. The arrangement of the present invention also has many other advantages, such as avoidance of trouble due to the inundation of or the vibration of the rotating contactor.

What is claimed is:

1. In the method of controlling the cross-sectional shape of products in the rolling of such material as metallic plate, sheet or strip with work rolls, the improvement which comprises heating the work rolls each having a center hole of a considerably smaller diameter than the diameter of said rolls themselves and provided along the central axis of said rolls, the rolls being solid except for said center hole, by providing in said center hole a heat source and controllably applying heat from said heat source to the roll from within the hole and in the radial direction of the work rolls at a rate per unit time and per unit length of the roll for producing a sufficient temperature gradient substantially near and around said center hole, said gradient being established radially outwardly from said center hole for expanding the work rolls in the radial direction thereof for changing the amount of the roll crown and controlling the cross-sectional shape of the rolled product and said heat being applied in an amount which at most has only an insignificant effect on the surface temperature of the roll, whereby the amount of heat necessary for producing the temperature gradient and which is based on the initial crown of the work rolls, the size of the rolled material, weights per unit time and the aggregate of the material rolled and rolling temperature, can be directly calculated and the heat source controlled to produce the desired amount of heat.

2. A method as claimed in claim 1 in which the heat is applied at the middle portion along the length of the roll and is applied simultaneously at the end portions along the length of the roll.

3. A method as claimed in claim 1 in which the heat is applied at different points in the upper rolls than in the lower rolls so as to produce different heat patterns in the upper and lower rolls.

4. A method as claimed in claim 3 in which the heat is applied at points in the upper rolls and complementary points in the lower rolls so that complementary heat patterns are produced in the upper and lower rolls.

5. A method as claimed in claim 1 in which an amount of heat is supplied at the start of the rolling operation and at appropriate points sufficient to expand the portions of the roll for forming a crown substantially the size of the crown which will be formed when heat transfer into and out of the roll during the rolling operation reaches an equilibrium, and thereafter the amount of heat supplied is gradually adjusted at the various points along the roll as the roll heats up from the rolling operation for maintaining the size of the crown at about said size.

6. A method as claimed in claim 5 in which the heat is first applied at the central part of the length of the roll, and thereafter is gradually reduced as the roll heats up until sufficient heat is supplied from the rolling operation to maintain the crown at the desired amount, whereupon the heat to the central part of the length of the roll is discontinued, and thereafter supplying gradually increasing amounts of heat to the end portions of the roll for increasing the diameter thereof the a desired value for maintaining proper rolling conditions at the ends of the roll.

* * * * *